US005269353A

United States Patent [19]

Nanaji et al.

[11] Patent Number: 5,269,353

[45] Date of Patent: Dec. 14, 1993

[54] VAPOR PUMP CONTROL

[75] Inventors: Seifollah S. Nanaji; Edward A. Payne, both of Greensboro; Kenneth L. Pope, Walkerton; Hal C. Hartsell, Jr., Kernersville, all of N.C.

[73] Assignee: Gilbarco, Inc., Greensboro, N.C.

[21] Appl. No.: 968,390

[22] Filed: Oct. 29, 1992

[51] Int. Cl.[5] ..... B65B 3/18

[52] U.S. Cl. ..... 141/59; 141/44; 141/83; 141/45; 137/587

[58] Field of Search ..... 141/44-46, 141/59, 302, 83, 95; 137/587-589; 55/55, 387; 220/86.2, 89.1

[56] References Cited

U.S. PATENT DOCUMENTS

| | | | |
|---|---|---|---|
| 3,713,337 | 1/1973 | Stroman | 73/205 R |
| 3,729,995 | 5/1973 | Kovacs | 73/194 B |
| 4,101,056 | 7/1978 | Mattimoe et al. | 222/26 |
| 4,277,832 | 7/1981 | Wong | 364/510 |
| 4,703,661 | 11/1987 | Evers | 73/861.66 |
| 4,720,800 | 1/1988 | Suzuki et al. | 364/510 |
| 4,765,751 | 8/1988 | Pannone | 374/143 |
| 4,821,580 | 4/1989 | Jorritsma | 73/861 |
| 4,905,511 | 3/1990 | Reinhold | 73/168 |
| 5,038,838 | 8/1991 | Bergamini et al. | 141/59 |
| 5,040,577 | 8/1991 | Pope | 141/59 |
| 5,156,199 | 10/1992 | Hartsell, Jr. et al. | 141/83 |
| 5,195,564 | 3/1993 | Spalding | 141/1 |

*Primary Examiner*—Ernest G. Cusick

*Attorney, Agent, or Firm*—Rhodes, Coats & Bennett

[57] ABSTRACT

An apparatus for pumping recovered vapor in a vapor recovery liquid fuel dispenser includes a liquid fuel dispenser apparatus adapted to dispense liquid fuel to a liquid fuel dispenser nozzle proximate a fuel vapor passage. A transducer associated with the dispenser apparatus generates a liquid fuel flow signal indicative of the rate of liquid fuel flow therethrough. A vapor pump driven by an electric motor is arranged to pump vapor from the vapor passage through a vapor pump inlet to a vapor pump outlet and has a characteristic that the flow rate through the vapor pump at a given vapor pump operating speed is inversely proportional to the difference between the vapor pump inlet and outlet pressures. Sensors associated with the inlet and outlet ascertain inlet and outlet pressures and generate signals representative thereof. A controller for the vapor pump includes vapor recovery control electronics and motor drive electronics. The vapor recovery electronics receive the pressure signals, a vapor pump speed signal and the liquid fuel flow signal and output a motor velocity modulation signal to the motor drive electronics to correlate the vapor pump flow rate with the liquid fuel flow rate. The motor drive electronics convert the motor velocity modulation signal to a voltage drive signal to the motor to adjust the vapor pump operating speed. Any discrepancies between the vapor pump flow rate derived from the pressure signals and the liquid fuel flow rate are thereby reduced.

19 Claims, 2 Drawing Sheets

VAPOR PUMP CONTROL

BACKGROUND OF THE INVENTION

The present invention relates to improvement in vapor pump flow rate controlling, particularly as applied in vapor recovery type liquid fuel dispensers.

Vapor pumps are known, and one of the most prevalent vapor pump designs is known as a positive displacement type. These may be used in vapor recovery fuel dispensers, which have gained popularity in recent years as the appreciation of the need to reduce environmental pollution has increased.

In particular, vapor recovery fuel dispensers, such as gasoline dispensers, are equipped with add-on components to supplement the main task of dispensing liquid fuel from a fuel reservoir to a receptacle, such as a motor vehicle tank. The add-on components include a vapor recovery line and a vapor pump, with a vapor recovery line open in the region of the liquid dispensing nozzle. The pumping of liquid into, for example, a motor vehicle gas tank, forces vapor out of the gas tank, and the operation of the vapor recovery pump retrieves those vapors and sends them back to the gasoline reservoir, where they can recondense, rather than escaping to the atmosphere to form pollution.

It is known that the rate of flow of the vapor in the vapor recovery portion of the system should be selected to avoid two undesired conditions. First, a vapor flow rate which is too low will not retrieve all of the vapor, thus permitting pollution to go on. A vapor recovery flow rate which is too high will pull in air, along with the vapor. The oxygen component of the air, if allowed to build to a relatively high level, can cause a dangerously explosive mixture to exist in the fuel reservoir. Accordingly, the vapor flow rate is of critical concern. Several prior endeavors have focused on calculating what the desired flow rate ought to be. For example, U.S. Pat. No. 5,040,577 to Pope, the disclosure of which is hereby incorporated by reference, describes a vapor recovery system in which the speed of the vapor recovery pump is set by a microprocessor so its volumetric flow rate matches the volumetric flow rate of the liquid dispenser. In one embodiment, the volumetric flow of the vapor recovery pump is modified so as to maintain an expected pressure at its input.

In application Ser. No. 824,702, filed Jan. 21, 1992, now U.S. Pat. No. 5,156,199, there is disclosed a system for selecting a desired vapor flow rate which is modified from the liquid flow rate, to account for thermal expansion or contraction of the vapor caused by heat exchange with the liquid.

U.S. Pat. No. 5,038,838 to Bergamini et al. discloses a system in which the vapor pump is continuously controlled to draw in a volumetric quantity of a vapor/air mixture equal to the volumetric quantity of fuel delivered, plus a possible excess of air.

However, none of the aforementioned systems disclose or suggest how to monitor the actual flow rate through the vapor pump and compensate for any deviations from a desired flow rate.

Such deviations may be introduced by various aspects of the vapor recovery fuel dispenser system, and may vary from one installation to another. Variations in components such a hose length, the presence of liquid in the vapor line, or dirt/particle deposits on the inside of the vapor lines influence the inlet vacuum and/or discharge pressure. This influence increases or decreases the vacuum and/or discharge pressure, which in turn affects the amount of vapor flow through the vapor recovery system. Other components of the system which might influence the pressure differential across the pump and its resultant flow rate are the presence of hose breakaways, smaller size vapor return piping, and the like.

Accordingly, there remains a need in the art for a method and apparatus for monitoring the flow rate through the vapor pump and correcting for any discrepancies between a desired and ascertained flow rate.

SUMMARY OF THE INVENTION

The present invention fulfills this need in the art by providing an apparatus for pumping recovered vapor in a vapor recovery liquid fuel dispenser including a vapor passage and a vapor pump arranged to pump vapor from the vapor passage through a vapor pump inlet to a vapor pump outlet and having a characteristic that the flow rate through the vapor pump at a given vapor pump operating speed is determinable from the difference between the vapor pump inlet and outlet pressures. Sensors associated with the inlet and outlet are provided to generate signals representative of the inlet and outlet pressures. A controller for the vapor pump is arranged to receive the pressure signals and a desired vapor pump flow rate datum and is adapted to adjust the vapor pump operating speed to reduce any discrepancies between a vapor pump flow rate derived from the pressure signals and the desired vapor pump flow rate datum.

In a preferred embodiment, the vapor pump has a characteristic that the flow rate through the vapor pump at a given operating speed is inversely proportional to the difference between the vapor pump inlet and outlet pressures.

Typically, the vapor pump is driven by an electric motor and the controller includes vapor recovery control electronics and motor drive electronics. The electronics receives the desired vapor pump flow rate datum, the pressure signals and a vapor pump speed signal and outputs a voltage drive signal to the motor. In a preferred embodiment, the vapor recovery control electronics receives the desired vapor pump flow rate datum, the pressure signals and a vapor pump speed signal and outputs a motor velocity modulation signal to the motor drive electronics. The motor drive electronics, in turn, outputs a voltage drive signal to the motor.

the apparatus is useful in a liquid fuel dispenser apparatus adapted to dispense liquid fuel. A transducer associated with the dispenser apparatus generates a liquid fuel flow signal indicative of the rate of liquid fuel flow and applies the liquid fuel flow signal to the controller as the desired vapor pump flow rate datum. Alternatively, the liquid fuel flow signal may pass through an intermediate processor to determine the desired vapor pump flow rate datum. For example, the intermediate processor may modify the liquid fuel flow signal to compensate for thermal contraction or expansion of the vapor arising from temperature differences between the liquid fuel and the vapor.

The invention also provides a method for pumping recovered vapor in a vapor recovery liquid fuel dispenser. The method includes providing a vapor pump having a characteristic that the flow rate through the vapor pump at a give vapor pump operating speed is determinable from the difference between the vapor pump inlet and outlet pressures and pumping vapor with the vapor pump from a vapor passage through a vapor pump inlet to a vapor pump outlet. The pressures at the inlet and outlet of the vapor pump are sensed, and the vapor pump speed is controlled in response to the sensed pressures and a desired vapor pump flow rate to reduce any discrepancies between a vapor pump flow rate derived from the sensed pressures and a desired vapor pump flow rate. In a presently preferred embodiment, the pump flow rate is inversely proportional to the pressure difference.

The method preferably includes driving the vapor pump by an electric motor and the controlling step includes controlling the electric motor, such as by outputting a voltage drive signal to the motor.

The method advantageously includes dispensing liquid fuel at a liquid fuel flow rate and using the liquid fuel flow rate as the desired vapor pump flow rate. Alternatively, the liquid fuel flow rate and the respective liquid fuel and vapor temperatures may be used to derive the desired vapor pump flow rate.

The invention is useful for the dispensing of volatile liquids generally, where the recovery of the vapors of the liquids is desired. Therefore the invention should be deemed to include methods and apparatus for pumping recovered vapor in a dispenser for other volatile liquids, in addition to liquid fuels.

BRIEF DESCRIPTION OF THE DRAWINGS

The invention will be better understood after a reading of the Detailed Description of the Preferred Embosdiment along with a review of the drawings in which.

DETAILED DESCRIPTION OF THE PREFERRED EMBODIMENT

Figure 1:
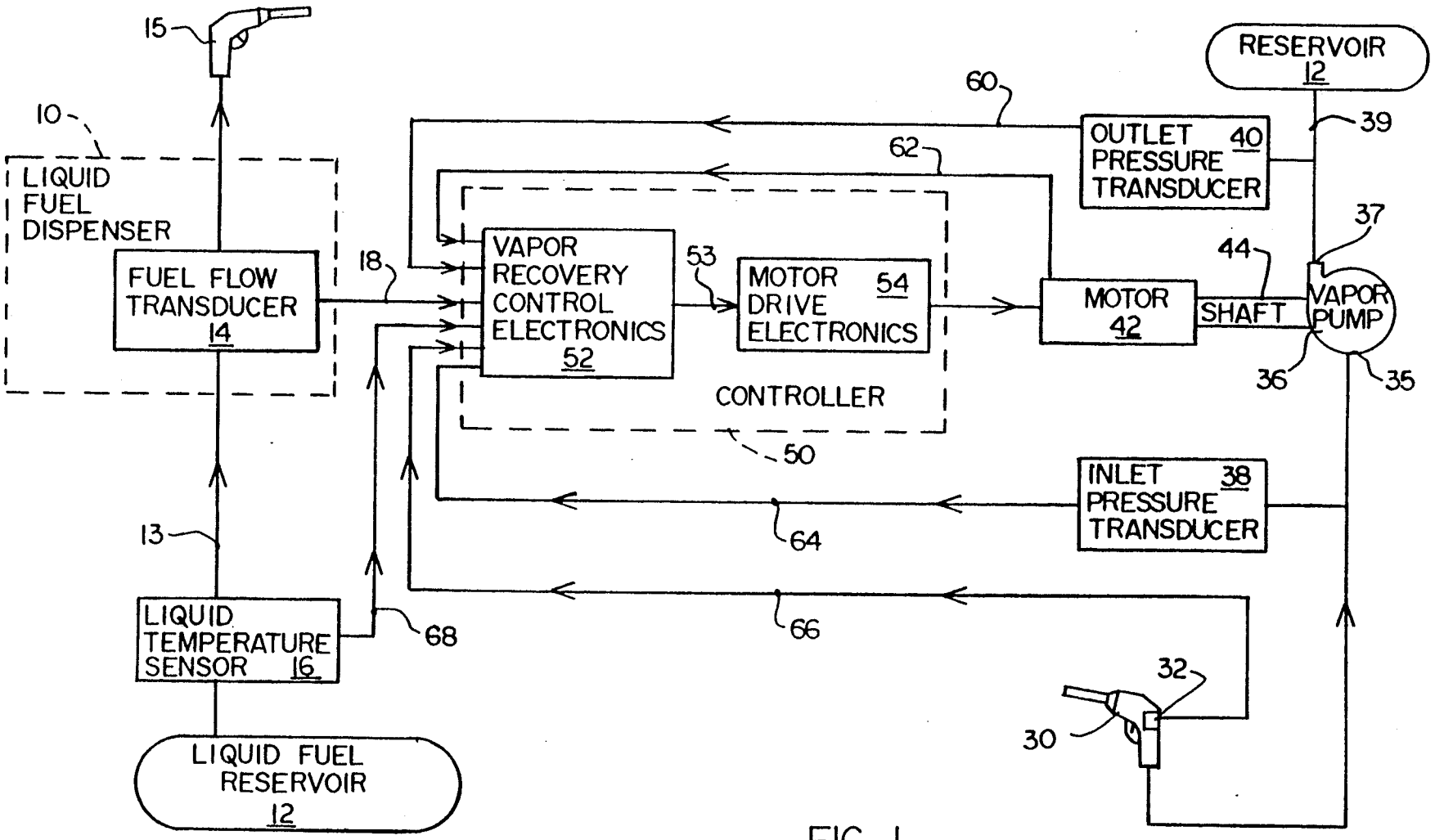
FIG. 1 is a block diagram of a vapor recovery fuel dispenser according to a preferred embodiment of the invention.

Referring now to FIG. 1, which is block diagram of the components of the present invention as installed in a vapor recovery liquid fuel dispensing system. A conventional liquid fuel dispenser 10 draws fuel from a reservoir 12 along a liquid inlet line 13 and discharges it through a outlet line 17, typically to a nozzle 15 adapted to fit into the filler pipe of a motor vehicle tank. Interposed between the lines 13 and 17 is a fuel flow transducer 14 which measures the liquid flow rate passing through the dispenser 10. This flow rate is conventionally used to determine the amount of fuel sold. However, in the present invention, a signal representing the volumetric liquid flow rate is also fed to a controller 50 along line 18.

Vapor is retrieved through an orifice at the nozzle 15, shown schematically in FIG. 1 as a vapor passage 30 through nozzle 15. The vapor line 34 from the vapor passage 30 generally parallels and juxtaposes, in practice, the line 17. The vapor is induced to move along line 34 by a vapor pump 36 which pumps the vapor from the passage 30 to the reservoir 12 (shown schematically as a second reservoir, but in actuality, the same as the first-mentioned reservoir 12). Within reservoir 12 the vapor may be available for condensation and reuse. Upstream of the pump 36 is a vapor pump inlet 35 and downstream is a vapor pump outlet 37. The pressures at the inlet and outlet are measured by sensors such as inlet pressure transducer 38 and outlet pressure transducer 40. The signals from these sensors are passed along lines 60,64 to the controller 50. Similarly, the temperature of the liquid fuel in the reservoir 12 is sensed by a temperature sensor 16 which passes a temperature signal along line 68 to the controller 50. Other sensor locations may be used, if desired. The temperature of the vapor is sensed by a temperature sensor 32, with a corresponding signal being passed along line 66 to the controller 50. The vapor temperature may, if desired, be approximated by measuring the ambient temperature.

The vapor pump 36 is driven by shaft 44 of electric motor 42. Thus, the speed of the electric motor 42 is transmitted to the vapor pump and directly affects the vapor pump speed. A signal of that speed is passed along line 62 back to the controller 50. The controller 50 includes vapor recovery control electronics 52 and motor drive electronics 54. The vapor recovery control electronics 52 receives the various input signals 60,62,64,66,68,18 and outputs a velocity modulation signal 53 to the motor drive electronics 54 which suitably configures the motor velocity modulation signal as an output voltage drive signal 55 to the motor 42. For example, if the motor 42 is a stepper motor, the motor drive electronics 54 may modify a DC-type analog signal to a pulse train. The exact configuration of the vapor recovery electronics 52 and motor drive electronics 54 may be selected by those of ordinary skill in the art according to the nature of the various input sensor signals and the motor type.

In particular, the vapor recovery control electronics 52 compares the difference between the inlet and outlet pressure signals 60,64 as a measure of the actual volumetric flow rate through the vapor pump 36 and compares the so-calculated vapor flow rate with a desired flow rate. The desired flow rate may be the actual liquid fuel flow rate represented by signal 18. Preferably, that flow rate is modified to take account of the differences in temperature of the vapor and liquid, as signalled to the vapor recovery control electronics 52 along lines 66,68, in accordance with principles set forth in U.S. Pat. No. 5,156,199 to Hartsell et al., the entire disclosure of which is hereby incorporated herein by reference.

The desired vapor flow rate may, of course, be determined by other means, if desired. What is important is that the desired flow rate be compared with the ascertained actual flow rate, the actual flow rate being ascertained from the differences in the inlet and outlet pressures across the vapor pump 36.

Figure 2:
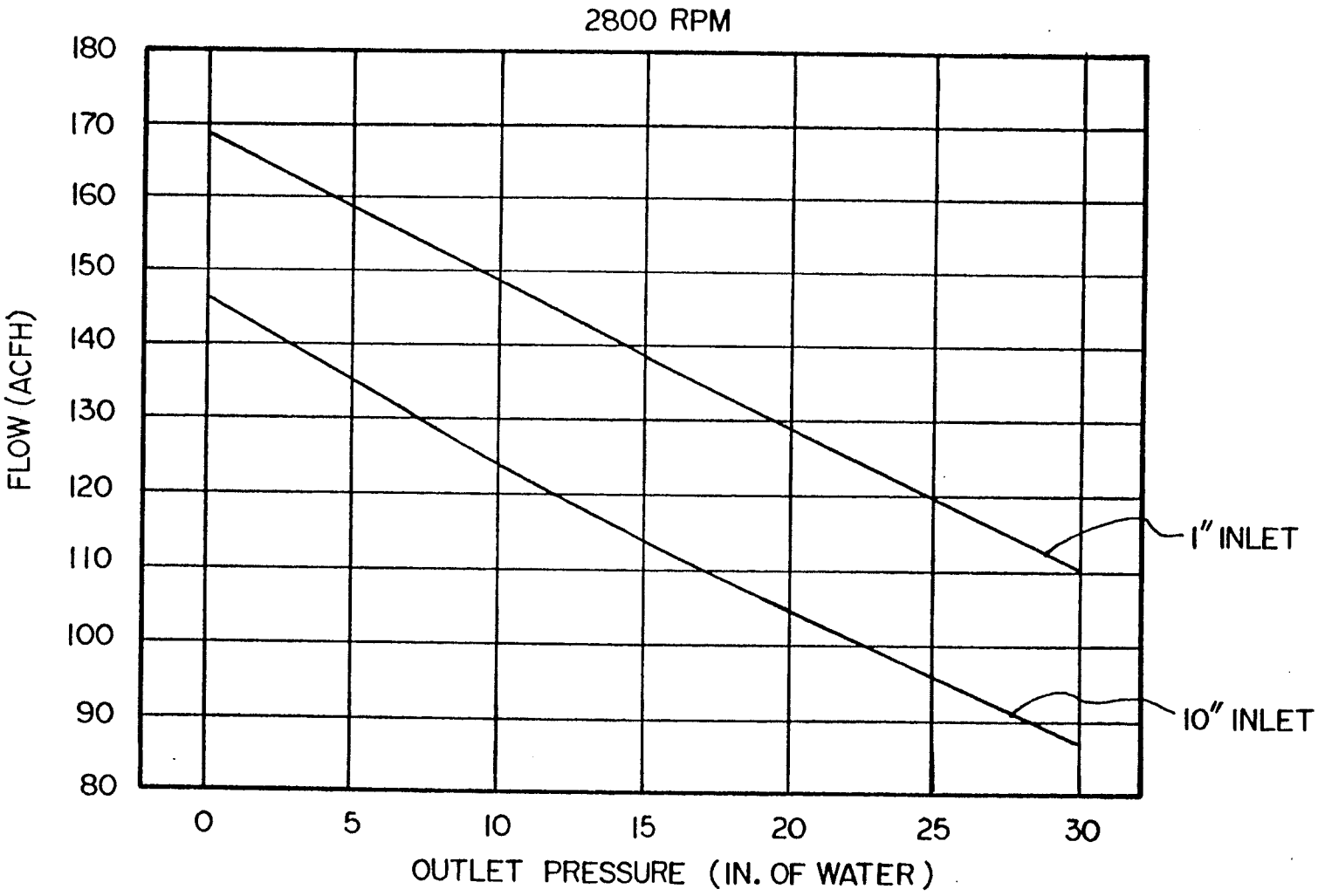
FIG. 2 is a graph of the vapor flow rate correlated with the pressure across the vapor pump used in the preferred embodiment.

Referring now to FIG. 2, a graph of a characteristic of a vapor pump 36 illustrates how the difference in the inlet and outlet pressures may be used to give a measure of the flow rate. The data recorded in FIG. 2 is representative of characteristics of Blackmer Positive Displacement Pump Model VRG 3/4, operating at 2800 rpm. Two plots are shown.

The ordinate of the graph shows the flow rate through the vapor pump in actual cubic feet per hour. The abscissa shows the outlet pressure, such as the signal on line 60, in inches of water. The upper plot shows a relationship of these two variables for a constant inlet vacuum of 1" of water, comparable to the signal along line 64. The lower plot shows the same relationship for a 10" inlet vacuum. As can be seen, for each inlet vacuum, the flow rate is almost linearly inversely proportional to the outlet vacuum. In practice, the relationship can be treated as linear. Thus, by ascertaining the inlet and outlet pressures (measured as vacuum levels or otherwise), the actual flow rate can be derived quite readily using known mathematical techniques.

Since these characteristics will be characteristics of the vapor pump, measuring the inlet and outlet pressure will give a vapor pump flow rate measurement. That calculated measurement can be used to determine if there is a deviation from a desired vapor pump flow rate, and the speed of the motor 42 can be modified to reduce any such discrepancy.

The discrepancies may arise from various temporary or permanent restrictions or obstructions along the lines 34,39 from the vapor passage 30 back to the reservoir 12. Prior to the present invention, such aberrations could cause inappropriate vapor pump flow rates which could lead to the release of vapors to the atmosphere, dangerous buildup of oxygen in the reservoir 12, or decreases in the vapor recovery efficiency. The invention solves this problem.

In operation, when fuel is to be dispensed through the outlet nozzle 15, it is drawn from the reservoir 12 along line 13 and measured in the fuel flow transducer 14. The fuel flow rate in the transducer 14 is signalled along line 18 to the controller 50, along with an indication of the liquid temperature along line 68. At the same time, the vapor recovery component is started, so that the vapor pump 36 begins drawing vapor from the vapor passage 30 along line 34,39 back to the reservoir 12. The temperature of the vapor or the ambient is signalled along line 66 to the controller 50. The vapor recovery control electronics 52 of the controller 50 outputs to the motor drive electronics 54 a motor or velocity modulation signal 53, which is selected to have the vapor flow rate match the liquid flow rate through the transducer 14, as modified to compensate for thermal contraction or expansion of the vapor. If desired, the temperature compensation may be omitted, or other compensations may be included. The motor drive electronics 54, in turn, shapes that signal and applies a modified version 55 to the electric motor 42 so that the shaft 44 of the motor 42 drives the vapor pump 36 at the desired speed. The vapor recovery control electronics 52 also receives the inlet and outlet pressure signals along lines 60,64, from which it can ascertain the actual vapor flow rate through the pump 36 and compare it with the desired vapor recovery flow rate. If the result of that comparison indicates that flow rate is insufficient, the motor velocity modulation signal 53 can be increased to speed up the electric motor 42 to compensate for such sensed deficiency in the vapor flow rate. The actual motor rate is sensed along line 62. If the flow rate through the vapor pump 36 is sensed as being too high, so that air is being pumped into the reservoir 12, the vapor recovery control electronics can retard the speed of motor 42, to reduce the flow rate through the vapor pump 36.

Those of ordinary skill in the art will appreciate that the invention may be applied to various other situations in which the vapor flow rate is desirably monitored and controlled, and that various other specific components may be assembled to accomplish the same objective.

What is claimed is:

1. An apparatus for pumping recovered vapor in a vapor recovery liquid fuel dispenser comprising a vapor passage, a vapor pump arranged to pump vapor from said vapor passage through a vapor pump inlet to a vapor pump outlet and having a characteristic that the flow rate through the vapor pump at a given vapor pump operating speed is determinable from the difference between the vapor pump inlet and outlet pressures, a signal source to generate a desired vapor pump flow rate datum, sensors associated with said inlet and outlet to generate signals representative of the inlet and outlet pressures, and a controller for said vapor pump arranged to receive the pressure signals and the desired vapor pump flow rate datum and adapted to adjust the vapor pump operating speed to reduce any discrepancies between a vapor pump flow rate derived from the pressure signals and the desired vapor pump flow rate datum.

2. An apparatus as claimed in claim 1 wherein said vapor pump has a characteristic that the flow rate through the vapor pump at a given operating speed is inversely proportional to the difference between the vapor pump inlet and outlet pressures.

3. An apparatus as claimed in claim 1, further comprising an electric motor and wherein said vapor pump is driven by said electric motor and said controller includes vapor recovery control electronics and motor drive electronics.

4. An apparatus as claimed in claim 1 further comprising an electric motor and wherein said vapor pump is drived by said electric motor and said controller includes an electronic device receiving the desired vapor pump flow rate datum, the pressure signals and a vapor pump speed signal and outputs a drive signal to said motor.

5. An apparatus as claimed in claim 1, further comprising an electric motor and wherein said vapor pump is driven by said electric motor and said controller includes vapor recovery control electronics, and motor drive electronics, said vapor recovery control electronics receiving the desired vapor pump flow rate datum, the pressure signals and a vapor pump speed signal and outputting a motor velocity modulation signal to said motor drive electronics

6. An apparatus as claimed in claim 5 wherein said motor drive electronics outputs a voltage drive signal to said motor.

7. An apparatus as claimed in claim 1 further comprising a liquid fuel dispenser apparatus adapted to dispense liquid fuel and said signal source is a transducer associated with said dispenser apparatus adapted to generate a liquid fuel flow signal indicative of the rate of liquid fuel flow and to apply the liquid fuel flow signal to said controller as the desired vapor pump flow rate datum.

8. An apparatus as claimed in claim 1 further comprising a liquid fuel dispenser apparatus adapted to dispense liquid fuel and a transducer associated with said dispenser apparatus adapted to generate a liquid fuel flow signal indicative of the rate of liquid fuel flow and to apply the liquid fuel flow signal to said controller which includes circuitry serving as the signal source of the desired vapor pump flow rate datum derived from the liquid fuel flow signal.

9. An apparatus as claimed in claim 8 wherein said controller modifies the liquid fuel flow signal to account for temperature differences between the liquid fuel and the vapor.

10. An apparatus for pumping recovered vapor in a vapor recovery liquid fuel dispenser comprising a liquid fuel dispenser apparatus adapted to dispense liquid fuel including a fuel vapor passage and a transducer associated with said dispenser apparatus adapted to generate a liquid fuel flow signal indicative of the rate of liquid fuel flow therethrough, a vapor pump driven by an electric motor and arranged to pump vapor from said vapor passage through a vapor pump inlet to a vapor pump outlet and having a characteristic that the flow rate through the vapor pump at a given vapor pump operating speed is inversely proportional to the differences between the vapor pump inlet and outlet pressures, a sensor associated with said electric motor to generate a vapor pump speed signal, sensors associated with said inlet and outlet to generate signals representative of the inlet and outlet pressures, and a controller for said vapor pump including vapor recovery control electronics and motor drive electronics, said vapor recovery electronics being arranged to receive the pressure signals, said vapor pump speed signal and said liquid fuel flow signal and adapted to determine a desired vapor pump flow rate correlated with the liquid flow rate and to reduce any discrepancies between the desired vapor pump flow rate and a vapor pump flow rate derived from pressure signals and to output a motor velocity modulation signal to said drive electronics, and said motor drive electronics arranged to convert said motor velocity modulation signal to a voltage drive signal to said motor to adjust the vapor pump operating speed.

11. A method for pumping recovered vapor in a vapor recovery liquid fuel dispenser comprising providing a vapor pump having a characteristic that the flow rate through the vapor pump at a given vapor pump operating speed is determinable from the difference between the vapor pump inlet and outlet pressures, pumping vapor with the vapor pump from a vapor passage through a vapor pump inlet to a vapor pump outlet, sensing the pressures at the inlet and outlet of the vapor pump, and controlling the vapor pump speed in response to the sensed pressures and a desired vapor pump flow rate to reduce any discrepancies between a vapor pump flow rate derived from the sensed pressures and a desired vapor pump flow rate.

12. A method as claimed in claim 11 wherein the providing step includes providing a vapor pump that has a characteristic that the flow rate through the vapor pump at a given operating speed is inversely proportional to the difference between the vapor pump inlet and outlet pressures.

13. A method as claimed in claim 11 further comprising driving the vapor pump by an electric motor and wherein the controlling step includes controlling the electric motor.

14. A method as claimed in claim 11 further comprising driving the vapor pump by an electric motor and wherein the controlling step includes outputting a voltage drive signal to the motor.

15. A method as claimed in claim 11 further comprising dispensing liquid fuel at a liquid fuel flow rate and using the liquid fuel flow rate as the desired vapor pump flow rate.

16. A method as claimed in claimed 11 further comprising dispensing liquid fuel at a liquid fuel flow rate and using the liquid fuel flow rate and the respective liquid fuel and vapor temperatures to derive the desired vapor pump flow rate.

17. A method for pumping recovered vapor in a vapor recovery liquid fuel dispenser comprising dispensing liquid fuel at a liquid fuel flow rate, providing a vapor pump having a characteristic that the flow rate through the vapor pump at a given vapor pump operating speed is inversely proportional to the difference between the vapor pump inlet and outlet pressures, driving the vapor pump by an electric motor to pump vapor from a vapor passage through a vapor pump inlet to a vapor pump outlet, sensing the pressures at the inlet and outlet of the vapor pump, and controlling the electric motor to control the vapor pump speed in response to the sensed pressures and a desired vapor flow rate derived from the liquid fuel flow rate to reduce any discrepancies between a vapor pump flow rate derived from the sensed pressures and the desired vapor flow rate.

18. An apparatus for pumping recovered vapor in a dispenser for a volatile liquid comprising a volatile liquid dispenser apparatus including a nozzle and adapted to dispense volatile liquids through said nozzle, a vapor recovery line associated with said nozzle to effect evacuation of vapors proximate said nozzle, a vapor pump arranged to pump vapor from said vapor recovery line through a vapor pump inlet to a vapor pump outlet and having a characteristic that the flow rate through the vapor pump at a given vapor pump operating speed is determinable from the difference between the vapor pump inlet and outlet pressures, a signal source to generate a desired vapor pump flow rate datum, sensors associated with said inlet and outlet to generate signals representative of the inlet and outlet pressures, and a controller for said vapor pump arranged to receive the pressure signals and the desired vapor pump flow rate datum and adapted to adjust the vapor pump operating speed to reduce any discrepancies between a vapor pump flow rate derived from the pressure signals and the desired vapor pump flow rate datum.

19. A method for pumping recovered vapor in a volatile liquid dispenser comprising dispensing a volatile liquid through a nozzle, evacuating vapors proximate said nozzle through a vapor pump having a characteristic that the flow rate through the vapor pump at a given vapor pump operating speed is determinable from the difference between the vapor pump inlet and outlet pressures, sensing the pressures at the inlet and outlet of the vapor pump, and controlling the vapor pump speed in response to the sensed pressures and a desired vapor pump flow rate to reduce any discrepancies between a vapor pump flow rate derived from the sensed pressures and a desired vapor pump flow rate.

* * * * *